343-700 MS AU 254 EX
12/23/82 UR 4,366,484

United States Patent [19]

Weiss et al.

[11] 4,366,484

[45] Dec. 28, 1982

[54] TEMPERATURE COMPENSATED RADIO FREQUENCY ANTENNA AND METHODS RELATED THERETO

[75] Inventors: Michael A. Weiss, Nederland; Robert E. Munson, Boulder, both of Colo.

[73] Assignee: Ball Corporation, Muncie, Ind.

[21] Appl. No.: 246,325

[22] Filed: Mar. 23, 1981

Related U.S. Application Data

[63] Continuation of Ser. No. 974,423, Dec. 29, 1978, abandoned.

[51] Int. Cl.[3] ..... H01Q 1/38
[52] U.S. Cl. ..... 343/700 MS; 333/229
[58] Field of Search ..... 343/700 MS, 829; 333/229, 234, 235

[56] References Cited

U.S. PATENT DOCUMENTS

| | | | |
|---|---|---|---|
| 2,684,444 | 7/1954 | Fales | 343/767 |
| 3,970,972 | 7/1976 | Bunner | 333/234 |
| 4,160,976 | 7/1979 | Conroy | 343/700 MS |

FOREIGN PATENT DOCUMENTS

| | | | |
|---|---|---|---|
| 2538779 | 1/1975 | Fed. Rep. of Germany | 333/229 |
| 52-17749 | 2/1977 | Japan | 333/234 |

*Primary Examiner*—Eli Lieberman
*Attorney, Agent, or Firm*—Ball Corporation

[57] ABSTRACT

A resonant metallic conductor having a nominal resonant frequency which varies inversely with temperature is temperature compensated by association with a predetermined proportion of dielectric material which acts to increase the nominal resonant frequency with temperature so as to substantially temperature compensate an antenna structure.

27 Claims, 7 Drawing Figures

TEMPERATURE COMPENSATED RADIO FREQUENCY ANTENNA AND METHODS RELATED THERETO

This is a continuation of application Ser. No. 974,423 filed Dec. 29, 1978, now abandoned.

This invention is generally related to temperature compensated radio frequency antenna structures and methods for achieving such compensation. In particular, the preferred exemplary embodiments are temperature compensated radio frequency antennas of the resonant cavity type wherein the resonant cavity is loaded with a dielectric so as to temperature compensate the antenna structure.

Most radio frequency antennas have metallic resonant electrical conductor elements whose resonant dimensions define the nominal resonant frequency of the antenna. Upon reflection, it will be appreciated that as temperature changes occur, the actual physical length of such metallic conductors will also change due to expansion and contraction phenomenon. Most metals expand when heated (e.g. copper and aluminum) thus lengthening resonant dimensions and lowering the nominal resonant frequency of the antenna element.

For many applications and for many types of antenna structures (especially wide bandwidth), such effects may be negligible. However with resonant cavity radiators of the microstrip type (which are well-known, per se, in the art as described, for example, by R. E. Munson in "Conformal Microstrip Antennas and Microstrip Phased Arrays," IEEE Trans. Antenna Propag., vol. AP-22, No. 1, pp. 74–78, January 1974) these temperature effects can sometimes be unacceptable. Since the typical microstrip radiator is inherently a narrow bandwidth device, the temperature effects can be even more troublesome.

For example, assume a typical microstrip radiator having a nominal resonant frequency of 2 GHz and a 20 MHz bandwidth at a room temperature of approximately 22° C. In this example, the radiator and the underlying ground plane are assumed to be formed from copper and separated by a Teflon/fiberglass (e.g. Type 6098 manufactured by 3M) layer approximately one-thirty second (1/32 or 0.031) inch thick. Such antenna elements are sometimes required to operate in temperature ranges of more than ±250° F. For purposes of illustration, if this same antenna is assumed to operate in an environment of approximately 120° C., then experience indicates that the nominal resonant frequency can be expected to shift to approximately 2.025 GHz. The bandwidth of the radiator stays approximately constant with temperature; however, as should now be apparent, the center frequency or resonant frequency of the antenna has actually shifted by approximately 25 MHz which is more than the entire bandwidth of the antenna.

Accordingly, when operating at such an elevated temperature, this particular radiator when used as a transmitter may be entirely misaligned (in the frequency domain) with a similar receiving microstrip antenna element operating at a different temperature. Of course the resonant frequency of the antenna may also be substantially different from the intended operating frequency of connected circuit components and the like as will be appreciated by those in the art.

Now, however, it has been discovered that these temperature dependent shifts in the resonant frequency of such a microstrip radiator are actually caused by two different factors. First of all, as briefly referenced above, the resonant dimensions of the metallic microstrip radiator structure change with temperature in a direction which tends to lower the resonant frequency. However, according to data published by the manufacturer of the Teflon/fiberglass dielectric (3M), the effective dielectric constant changes in such a way as to cause an increase in the antenna resonant frequency (the dielectric coefficient actually decreases with increasing temperature). However, since the temperature effects associated with the dielectric greatly exceed those associated with the resonant conductor dimensions, the net effect is still a substantial increase in the nominal frequency with increasing temperature. In fact, actual experience shows a somewhat greater temperature dependence than is theoretically predicted by published coefficients of metal expansion and coefficients of relative dielectric constant vs. temperature.

For example, it has been discovered that with a copper resonant conductor, the temperature expansion of the copper lowers the nominal resonant frequency by only about 10% (for aluminum the factor is approximately 20%) of the amount by which that resonant frequency is raised by temperature effects associated with the dielectric.

The 10% (and 20%) amount just mentioned is an approximation that can be justified as shown below. However, some experimentation will probably be required to obtain the optimum temperature compensation for any specific antenna structure.

Nevertheless, it is instructive to consider a microstrip radiator having a nominal 300 MHz resonant frequency. The calculated frequency change due to expansion of copper over 20°–200° C. is approximately −0.1 MHz. Yet an overall shift of approximately +4.8 MHz is actually observed. Thus, one may initially deduce that +4.8 MHz of the shift is due to changes in the dielectric. From this, one might be tempted to remove $(4.8-0.1)/4.8=0.98$ (or 98%) of the dielectric so as to balance the positive and negative temperature dependencies.

However the 98% factor is actually too large since removing a majority of the dielectric will result in an air-loaded cavity having a longer physical resonant dimension. The corresponding increase in the length of copper will result in a larger negative going frequency shift, thereby lowering the percentage of dielectric which should be removed.

For example, if an air-loaded cavity nominally resonant at 300 MHz is assumed then the calculated frequency shift over 20°–200° C. is −0.6 MHz. This calculation result appears to imply that only $(4.3-0.6)/4.3=0.86$ (or 86%) of the dielectric need be removed. However since there is actually still to be some dielectric loading, the 86% factor is too low. The correct factor is somewhere between 86% and 98%—i.e. close to 90%. A similar exercise for aluminum produces an approximately 80% factor due to the fact that the coefficient of thermal expansion for aluminum is about two (exactly 1.71) times that of copper.

The present invention has achieved temperature compensation in such microstrip or resonant cavity radiator structures by reducing the dielectric loading (e.g. approximately 90% reduction in the case of a copper radiator or approximately 80% reduction in the case of aluminum radiators) by the usual Teflon/fiberglass dielectric material.

Specifically, two 1/32 inch aluminum plates, 3.5×8.75 inches, were shorted along one of the short sides and separated by a ⅛" thick layer of Teflon/fiberglass dielectric, 0.3 inch wide about the periphery of the plates. (Approximately 22.8% of the cavity volume was filled with Teflon/fiberglass). The following temperature compensated operation was then observed:

| Temperature °F. | Resonant Frequency |
|---|---|
| −95 | 280.84 MHz |
| −50 | 280.95 MHz |
| 0 | 280.95 MHz |
| +50 | 281.00 MHz |
| +77 | 281.25 MHz |
| +100 | 281.68 MHz |
| +150 | 281.24 MHz |
| +200 | 281.38 MHz |
| +250 | 280.82 MHz |

In general, according to this invention, the dielectric material associated with the metallic resonant conductor is positioned relative to that conductor so as to substantially reduce the net change in its nominal frequency with respect to temperature. In the case of antenna radiators having a resonant cavity, this is conveniently achieved by occupying only a predetermined fraction of the resonant cavity with the Teflon/fiberglass or other dielectric material. In one preferred embodiment, the dielectric material is distributed around the periphery of the resonant cavity leaving the inner portion of the cavity void or filled with gas (possibly air) or plastic foam. In another preferred embodiment, also to be described below in more detail, the Teflon/-fiberglass material is greatly reduced in thickness and the remainder of the resonant cavity is occupied by a honeycomb, plastic foam, air, or simply void if the antenna is in a vacuum environment. Of course, suitable physical structure must be provided to maintain the proper spacing of the resonant cavity walls.

Antenna elements designed according to the apparatus and method of this invention have been discovered to have nominal resonant frequencies that are virtually insensitive to large changes in temperature. Thus it is no longer necessary to design microstrip antennas with unduly wide bandwidths for operation within wide temperature ranges as has been required in the past. This will result, in the case of a microstrip antenna, in antenna elements that are smaller, lighter and less costly to produce and may even enable performance which is not achievable otherwise.

These and other objects and advantages of this invention will be more completely appreciated by studying the following detailed description of presently preferred exemplary embodiments in conjunction with the accompanying drawings, of which:

Figure 1:
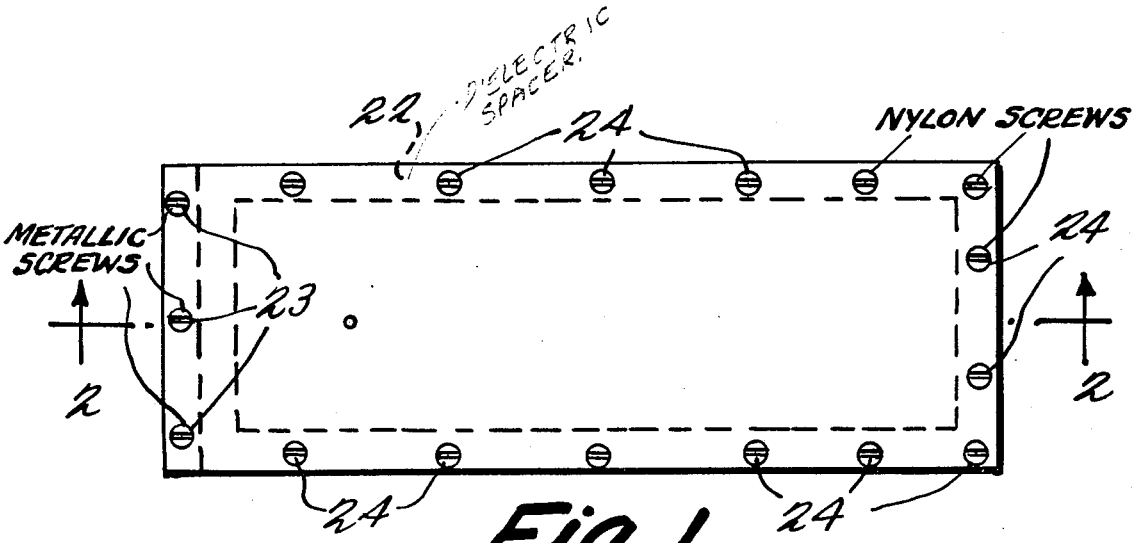
FIGS. 1 and 2 are plan and cross-sectional views respectively of a first exemplary embodiment of the invention.
Figure 2:
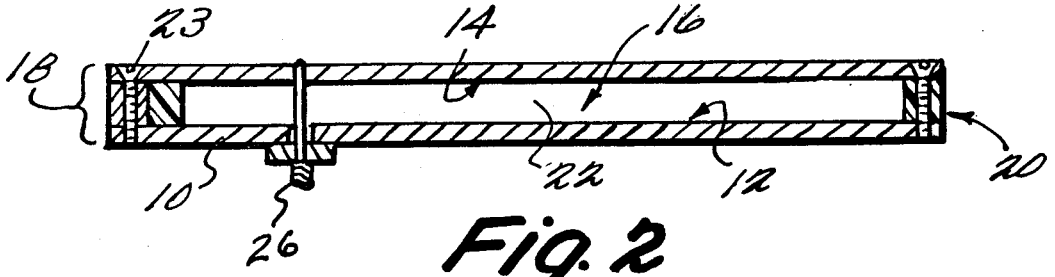

The embodiment shown in FIGS. 1 and 2 corresponds to the example for which dimensions and experimental results have already been given above. It comprises an aluminum body 10 having inner space between surfaces 12 and 14 which define a one-fourth wavelength resonant cavity 16 between the shorted end 18 and a radiating aperture 20. The dielectric spacer 22 extends only about the periphery of the resonant cavity as shown by dotted lines in FIG. 1. The aluminum cavity 10 may be assembled from three pieces held together with metallic screws 23 and nylon screws 24 as shown in FIGS. 1 and 2. The cavity is then fed by a conventional RF-connector 26. The connector 26 is typically connected to a coaxial cable with the shield connected to surface 12 and inner conductor connected to surface 14 at a point in the resonant cavity which substantially matches the impedence of the coaxial cable and as will be appreciated by those in the art.

The interior of the resonant cavity may be left void or substantially void such as by filling with the plastic foam or the like. Of course, if the antenna is operated in a vacuum environment, the interior of the resonant cavity could actually comprise a void. In any event, the relative dielectric constant of the interior portion is relatively unaffected by temperature changes while the changes in dielectric constant of the dielectric spacer 22 are just sufficient to offset the changes in resonant frequency which would otherwise be experienced due to thermal expansion of the aluminum member.

Figure 3:
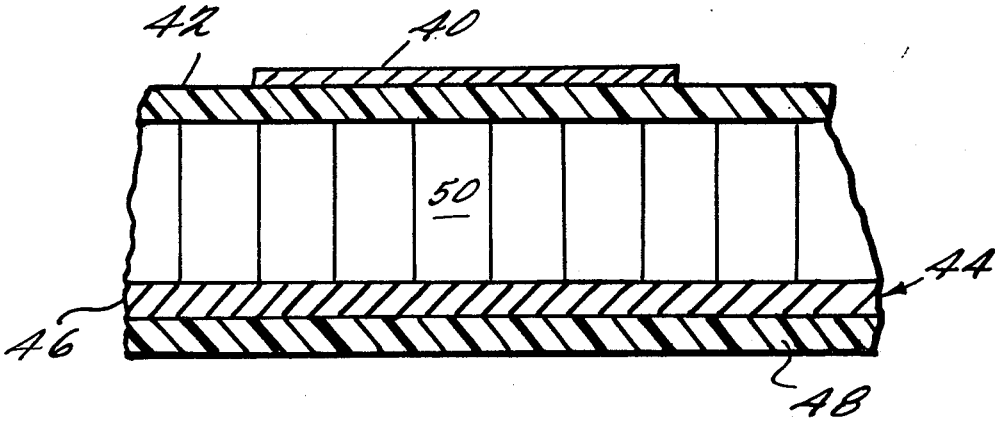
FIG. 3 is a cross-sectional view of another exemplary embodiment of this invention.

In the embodiment of FIG. 3, the dielectric loading is distributed in a relatively thin sheet near one of metallic surfaces defining the resonant cavity while the majority of the resonant cavity is substantially void or gas filled so as to have little if any temperature effect on the resonant frequency of the structure. This embodiment facilitates construction of higher frequency antenna structures where smaller radiating elements are precisely etched on a Teflon/fiberglass substrate which then remains to physically support the radiating element.

Accordingly in FIG. 3, the usual copper or aluminum radiating element 40 has been etched on one surface of a Teflon/fiberglass dielectric sheet 42. In this exemplary embodiment, copper is preferred and, in that event, the thickness of dielectric 42 is on the order of 0.005 inch. The underlying reference or ground plane surface 44 is formed by another copper or aluminum layer 46 bonded to a substrate 48. The Teflon/fiberglass dielectric 42 and its associated radiator 40 are physically supported above the ground plane 44 by a honeycomb structure 50 or a gas filled plastic foam material or otherwise physically supported to leave air, other gases or a void (if in a vacuum environment) between the Teflon/fiberglass layer 42 and the underlying ground plane 44. As will be appreciated, other physical arrangements of materials can be used to realize the proper proportion of dielectric loading associated with the radiating element 40.

Figure 4:
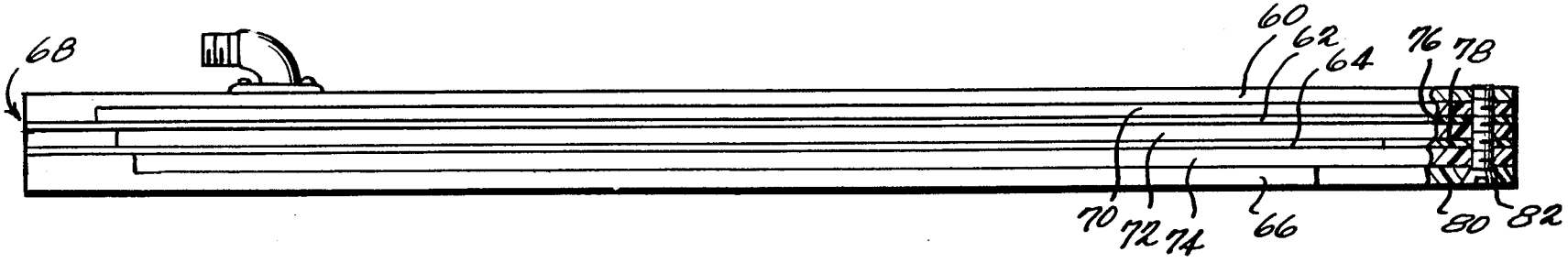
FIG. 4 is a side view, partly cut away, of a third exemplary embodiment of this invention.
Figure 5:
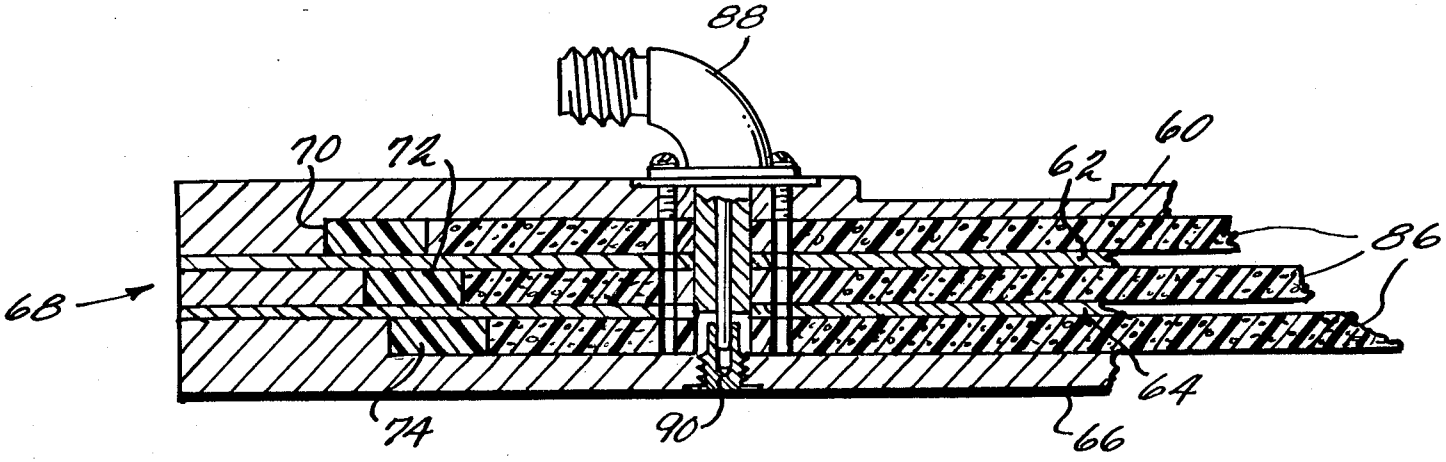
FIG. 5 is an exploded partial cross-sectional view of the embodiment shown in FIG. 4.
Figure 6:
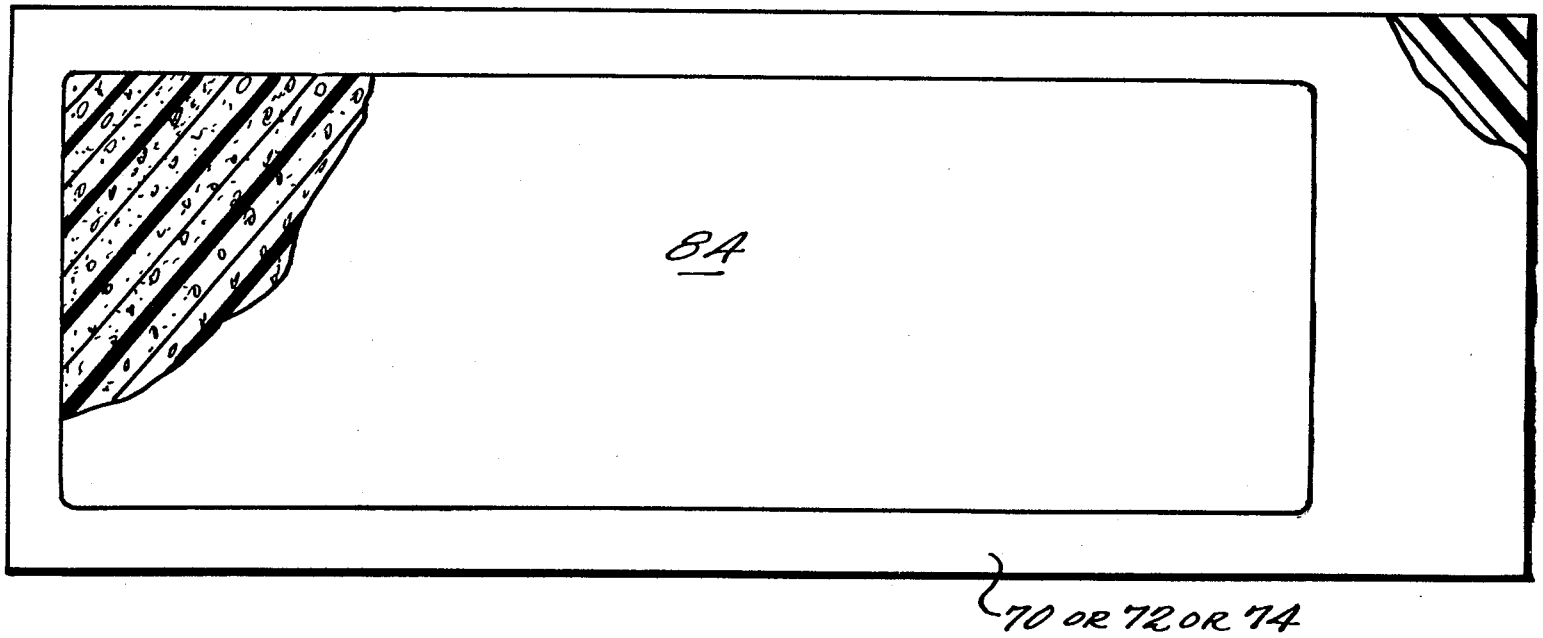
FIG. 6 is a plan view of the dielectric elements employed in the embodiment of FIG. 4.

The exemplary embodiment shown in FIGS. 4–6 is, in principle, substantially similar to that shown in FIGS. 1 and 2. However, in FIGS. 4–6, three resonant cavities are formed and simultaneously fed. Of course, only the particular cavity having a resonant frequency corresponding to the supplied input signals would actually be active at any given time.

The metallic (aluminum) members 60,62,64 and 66 are formed from rectangular sheet stock and may be braized together into one unitary structure at the shorted end 68 of the resonant cavity structure. The three resonant cavities 70,72 and 74 are each loaded with a dielectric element. The right hand end of these dielectric elements, as seen in FIG. 4, is extended and bonded together with dielectric spacers 76,78 and 80 into a second integral structure that mates with the metallic unitary member earlier described. The unitary dielectric and metallic members may then be assembled and fastened with dielectric screws 82.

The dielectric elements, per se, are of the general shape shown in FIG. 6 which extend only about the periphery of each resonant cavity. As earlier mentioned and as also seen in FIG. 6, the right hand end of these dielectric elements is extended so as to permit bonding with dielectric spacers thus forming an integral dielectric member for construction purposes. Of course, the actual dimensions of each dielectric element will vary according to the dimensions of each resonant cavity.

The inner void 84 of each dielectric member 70,72 or 74 is filled with a plastic foam layer 86 (see FIG. 5) to help maintain the correct resonant cavity dimensions. The foam layers 86 are preferably cut just slightly thicker than the actual resonant cavity dimension and slightly compressed when the dielectric elements are mated with the metallic elements in assembling the structure of FIG. 4.

As seen in FIG. 5, a typical RF-connector 88 has its outer conductor connected to metallic member 60 and its inner conductor fed down to a connection with metallic member 66. The threaded connecting insert 90 has an inner cylindrical chamber which permits the inner conductor of the coaxial connector 88 to move axially with thermal expansion and contraction forces.

In the embodiment of FIGS. 4–6, the metallic members are formed from aluminum and the dielectric elements are formed from Teflon/fiberglass. The plastic foam 86 is a rigid polyurethane ecco foam having a density of approximately two pounds per cubic foot and a relative dielectric constant of approximately 1.04. The dielectric screws 82 may be formed from nylon.

With the structure of FIG. 3 a resonant cavity having a nominal resonant frequency of 1664 MHz and a bandwidth of approximately 90 MHz, has been found to have a temperature deviation of only approximately 15 MHz over a temperature range of −65° C. to 125° C.

Figure 7:
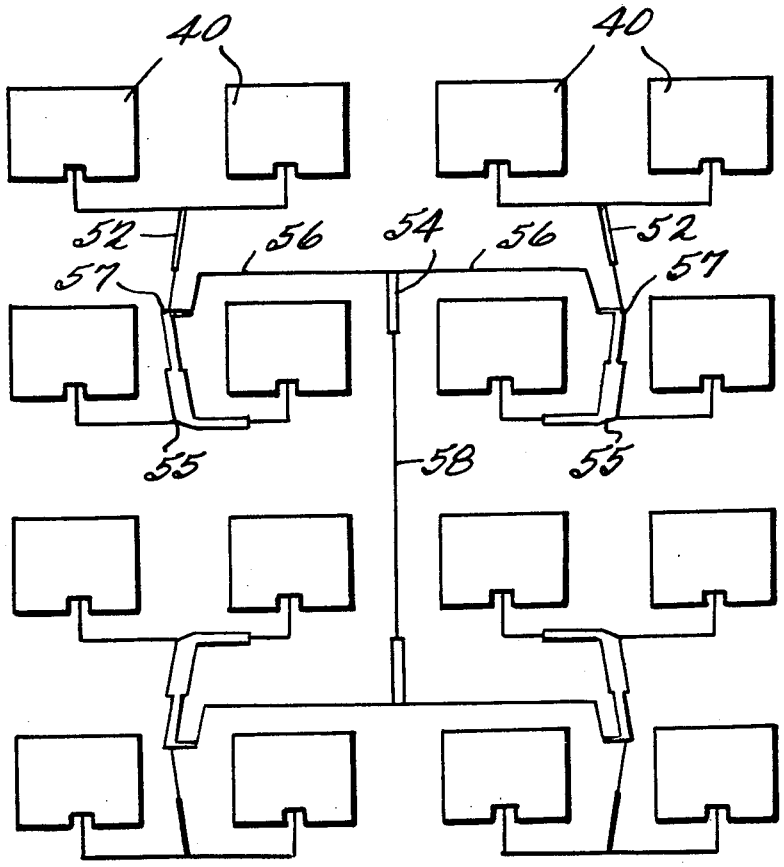
FIG. 7 is a plan view of an array of temperature compensated antenna structures according to this invention.

In FIG. 7, the embodiment of FIG. 3 is employed a multiple number of times to form an array of temperature compensated antenna structures. The feed system for this array employs the same embodiment as the radiating element 40 shown in FIG. 3. The impedance and phase lengths of feedlines 56 and 58, matching transformers 52 and 54, and power dividers 55 and 57 remain essentially constant with temperature.

While only a few specific exemplary embodiments of this invention have been described in detail above, those skilled in the art will appreciate that there are many possible variations of these embodiments which would still incorporate the novel and advantageous features of this invention. Accordingly, all such variations and modifications are intended to be within the scope of this invention as defined in the following claims.

What is claimed is:

1. A temperature compensated radio frequency microstrip antenna comprising:

a metallic resonant electrical microstrip radiation patch conductor disposed above a ground plane to define at least one radiating aperture between an edge of said patch and said ground plane, said patch conductor having a nominal resonant frequency and a nominal resonant dimension which changes with temperature changes so as to change said nominal resonant frequency in a first direction, and dielectric material partly filling the volume under said resonant patch conductor and above said ground plane and having an effective dielectric constant which changes with temperature changes so as to change said nominal resonant frequency in a second direction opposite to said first direction, said dielectric material comprising solid material filling only a predetermined fractional portion of said volume so as to substantially reduce the net change in said nominal resonant frequency with respect to temperature.

2. A temperature compensated radio frequency electromagnetic signal microstrip radiator antenna comprising:

an electromagnetic signal radiating aperture;

a resonant cavity having a nominal resonant frequency and being defined by a first metallic member disposed above a second metallic member which together define said radiating aperture, said first metallic member having resonant dimensions which change with temperature changes so as to change said nominal resonant frequency in a first direction, and a dielectric material disposed within said resonant cavity and having an effective dielectric constant which changes with temperature changes so as to change said nominal resonant frequency in a second direction opposite to said first direction, said dielectric material occupying only the predetermined fraction of said resonant cavity required to substantially reduce the net change in said nominal resonant frequency over a predetermined range of temperature changes.

3. A temperature compensated radio frequency electromagnetic signal radiator as in claim 2 wherein said dielectric material comprises Teflon/fiberglass.

4. A temperature compensated radio frequency electromagnetic signal radiator as in claim 2 or 3 wherein said metallic members comprise aluminum.

5. A temperature compensated radio frequency electromagnetic signal radiator as in claim 4 wherein said predetermined fraction is approximately one-fifth.

6. A temperature compensated radio frequency electromagnetic signal radiator as in claim 2 or 3 wherein said metallic members comprise copper.

7. A temperature compensated radio frequency electromagnetic signal radiator as in claim 6 wherein said predetermined fraction is approximately one-tenth.

8. A temperature compensated radio frequency microstrip antenna comprising:

a radiating aperture, a reference conductor surface;

a resonant-dimensioned conductor spaced above said reference conductor surface to define said radiating aperture therebetween, said resonant-dimensioned conductor having a resonant frequency which decreases with increasing temperature due to temperature induced increases in its resonant dimensions; and a dielectric member comprising solid material disposed between said reference conductor surface and said resonant-dimensioned conductor, said dielectric member having an effective dielectric constant which decreases with increasing temperature and which thereby causes a corresponding increase in the resonant frequency of said resonant-dimensioned conductor with increasing temperature, said resonant-dimensioned conductor and said dielectric member being relatively proportioned and made of appropriate materials to produce a substantially reduced net resonant frequency change over a predetermined range of temperature.

9. A temperature compensated radio frequency antenna as in claim 8 wherein said dielectric member comprises Teflon/fiberglass.

10. A temperature compensated radio frequency antenna as in claim 8 or 9 wherein at least said resonant-dimensioned conductor comprises aluminum material.

11. A temperature compensated radio frequency antenna as in claim 10 wherein said dielectric member extends over only approximately 20% of the resonant-dimensioned conductor.

12. A temperature compensated radio frequency antenna as in claim 10 wherein said dielectric member occupies only approximately 20% of the volume defined between said reference conductor surface and said resonant-dimensioned conductor.

13. A temperature compensated radio frequency antenna as in claim 8 or 9 wherein at least said resonant-dimensioned conductor comprises copper material.

14. A temperature compensated radio frequency antenna as in claim 13 wherein said dielectric member extends over only approximately 10% of the resonant-dimensioned conductor.

15. A temperature compensated radio frequency antenna as in claim 13 wherein said dielectric member occupies only approximately 10% of the volume defined between said referenced conductor surface and said resonant-dimensioned conductor.

16. A temperature compensated radio frequency antenna as in claim 8 or 9 wherein said reference conductor surface and said resonant-dimenstioned conductor are opposing spaced-apart surfaces defining a resonant cavity volume therebetween and wherein said dielectric member occupies only a predetermined fraction of such resonant cavity volume, said predetermined fraction being determined so as to substantially reduce said net resonant frequency change.

17. A method of compensating temperature induced changes in the nominal resonant frequency of a radio frequency microstrip antenna defined by a metallic resonant cavity having a radio frequency signal input and a radiating aperture output, said method comprising the step of introducing a predetermined solid dielectric material into a predetermined fractional portion of said resonant cavity so as to substantially reduce net changes in said nominal resonant frequency over a predetermined range of temperature.

18. A method as in claim 17 wherein said metallic resonant cavity comprises aluminum, said dielectric material comprises Teflon/fiberglass and said predetermined fraction is approximately one-fifth.

19. A method as in claim 17 wherein said metallic resonant cavity comprises copper, said dielectric material comprises Teflon/fiberglass and said predetermined fraction is approximately one-tenth.

20. An improved microstrip radio frequency antenna of the type having shaped metallic electrical conductive surface areas serving as resonant radiator patch(es) with electrical wavelength-related dimensions that increase with increasing temperature thus tending to decrease antenna operating frequency and also having a metallic conductive ground plane or reference surface spaced therebelow, at a substantially uniform short distance in terms of wavelength dimensions, by dielectric material, wherein the improvement comprises:

a negative temperature coefficient dielectric material which tends to increase antenna operating frequency with increasing temperature disposed in the volume defined between said metallic reference surface on one hand and said shaped metallic surface areas on the other hand, said negative temperature coefficient dielectric occupying only a predetermined fraction of said volume as required to achieve a narrowed range of microstrip antenna operating frequencies over a desired range of ambient temperatures.

21. An improved microstrip radio-frequency antenna as in claim 20 wherein said negative temperature coefficient dielectric material comprises a solid strip transversely extending between said conductive surfaces entirely across said volume.

22. An improved microstrip radio frequency antenna of the type having shaped metallic electrical conductive surface areas serving as resonant radiator patch(es) with electrical wavelength-related dimensions that increase with increasing temperature thus tending to decrease antenna operating frequency and also having a metallic conductive ground plane or reference surface spaced therebelow, at a substantially uniform short distance in terms of wavelength dimensions, by dielectric material, wherein the improvement comprises:

a negative temperature coefficient dielectric material including a solid sheet supporting said shaped conductive surface areas and wherein said solid sheet is itself disposed above said reference surface and supported there by a second dielectric structure, said negative temperature coefficient dielectric material tending to increase antenna operating frequency with increasing temperature and being disposed in the volume defined between said metallic reference surface on one hand and said shaped metallic surface areas on the other hand, said negative temperature coefficient dielectric occupying only a predetermined fraction of said volume as required to achieve a narrowed range of microstrip antenna operating frequencies over a desired range of ambient temperatures.

23. An improved microstrip radio frequency antenna of the type having shaped metallic electrical conductive surface areas serving as resonant radiator patch(es) with electrical wavelength-related dimensions that increase with increasing temperature thus tending to decrease antenna operating frequency and also having a metallic conductive ground plane or reference surface spaced therebelow, at a substantially uniform short distance in terms of wavelength dimensions, by dielectric material, wherein the improvement comprises:

a negative temperature coefficient dielectric material including a solid sheet disposed above substantially all of said reference surface but filling only a predetermined fraction of the volume defined between said metallic reference surface on one hand and said shaped metallic surface areas on the other hand, said negative temperature coefficient dielectric material tending to increase antenna operating frequency with increasing temperature occupying only a predetermined fraction of said volume as required to achieve a narrowed range of microstrip antenna operating frequencies over a desired range of ambient temperatures.

24. An improved microstrip radio frequency antenna as in claim 22 or 23 wherein said shaped conductive surface areas include integrally formed and connected feedline structure for conducting r.f. energy to/from said radiator patch(es) and also having wavelength-related dimensions which increase with increasing temperature.

25. An improved microstrip radio frequency antenna of the type having shaped metallic electrical conductive surface areas serving as resonant radiator patch(es) with electrical wavelength-related dimensions that increase with increasing temperature thus tending to decrease antenna operating frequency and also having a metallic conductive ground plane or reference surface spaced therebelow, at a substantially uniform short distance in terms of wavelength dimensions, by dielectirc material, wherein the improvement comprises:

a negative temperature coefficient dielectric material which tends to increase antenna operating frequency with increasing temperature disposed in the volume defined between said metallic reference surface on one hand and said shaped metallic surface areas on the other hand, said negative temperature coefficient dielectric occupying only a predetermined fraction of said volume as required to achieve a narrowed range of microstrip antenna operating frequencies over a desired range of ambient temperatures, and said negative temperature coefficient dielectric material including one portion of a multi-part dielectric structure which substantially occupies all of said volume.

26. An improved microstrip radio frequency antenna as in claim 25 wherein said multi-part dielectric structure includes a second honey-comb shaped portion.

27. An improved microstrip radio frequency antenna as in claim 25 wherein said multi-part dielectric structure includes a second foam-structured portion.

* * * * *